United States Patent [19]

Tajima et al.

[11] Patent Number: 4,995,748

[45] Date of Patent: Feb. 26, 1991

[54] RECIPROCATING PRINTING CARTRIDGE EXTENDING BEYOND CASING SIDEWALL OPENING

[75] Inventors: Noriyuki Tajima, Yawata; Shigeto Ueno, Neyagawa; Tetsuhiro Sano, Hirakata, all of Japan

[73] Assignee: Matsushita Electric Industrial Co., Ltd., Osaka, Japan

[21] Appl. No.: 378,911

[22] Filed: Jul. 12, 1989

[30] Foreign Application Priority Data

Jul. 18, 1988 [JP] Japan ..... 63-177112

[51] Int. Cl.[5] ..... B41J 29/02

[52] U.S. Cl. ..... 400/691; 400/693

[58] Field of Search ..... 400/691, 693, 685, 352, 400/357, 358, 207, 208

[56] References Cited

U.S. PATENT DOCUMENTS

| | | | |
|---|---|---|---|
| 3,711,175 | 1/1973 | Sottsass, Jr. | 400/691 |
| 4,446,790 | 5/1984 | Konkel et al. | 400/691 |
| 4,611,218 | 9/1986 | Watanabe | 400/208 |
| 4,830,525 | 5/1989 | Nagashima et al. | 400/691 |
| 4,846,595 | 7/1989 | Kato et al. | 400/691 |

FOREIGN PATENT DOCUMENTS

| | | | |
|---|---|---|---|
| 0230780 | 12/1984 | Japan | 400/208 |
| 0084270 | 4/1986 | Japan | 400/693 |
| 0161575 | 7/1987 | Japan | 400/691 |

*Primary Examiner*—Eugene H. Eickholt

*Attorney, Agent, or Firm*—Stevens, Davis, Miller & Mosher

[57] ABSTRACT

Disclosed is an information processing device such as a compact personal computer, word-processor, and the like containing a printer therein. The information processing device is provided, in a side surface of its outer casing, with an opening portion so as to permit projection of an end portion of an ink cartridge or carriage. Therefore, although the device is compact-sized, it is possible to enlarge the printable width of the device. This makes it possible to effect printing on a larger-sized sheet of paper.

8 Claims, 3 Drawing Sheets

RECIPROCATING PRINTING CARTRIDGE EXTENDING BEYOND CASING SIDEWALL OPENING

BACKGROUND OF THE INVENTION

1. FIELD OF THE INVENTION

The present invention relates to an information processing device such as that which is typically represented by a compact personal computer, word-processor and the like.

2. STATEMENT OF THE RELATED ART

With a recent progress in terms of the semiconductor technique, information processing devices such as personal computers, word-processors, and the like have been being miniaturized. Under this existing circumstance, all-in-one type portable data-processing devices, each of which contains a keyboard 1, a display means 2 and a printer (not shown) adapted to effect printing on a print paper 3, also, have recently been widely used. Further miniaturization has thus been being demanded.

Conventionally, a serial printer of heat-transfer type, which is low in cost and small in power consumption, is adopted for such type of portable data-processing devices.

FIG. 2 is a plan view showing an ordinary structure of the serial printer, the structure including a carriage 6 having loaded thereon a printing head 4 and an ink ribbon cartridge 5. The carriage 6 is reciprocatingly moved in the direction indicated by the arrow A while it is being guided along a guide shaft 10 by means of a belt 9 stretched between a drive pulley 7 and a driven pulley 8. Printing on the print paper 3 is effected by causing an electric current to pass through the printing head 4 while the carriage 6 is being moved.

With the above-described arrangement, however, the lateral width of the data-processing device as indicated by a dimensional line B in FIG. 1 is equal to or greater than a sum of the length of stroke of the carriage 6 and the width of the carriage 6 or the ink ribbon cartridge 5. This imposes a limitation upon the miniaturization of the device, as a problem. Another problem also exists that a reduction in lateral width of the device causes a reduction in stroke length of the carriage 6 resulting in a reduction in the printable width range as well.

SUMMARY OF THE INVENTION

The present invention has been made in view of the above-described problems inherent in the prior art and an object thereof is to provide a compact-sized information processing device which is capable of providing a wider printable range in which printing can be effected.

To attain the above object, according to the present invention, there is provided an information processing device which is constructed such that an opening portion is provided in at least one side surface of the outer casing of the device, whereby, when the carriage has reached a terminal end of the stroke length, a part of either one, or both, of the carriage and ink ribbon cartridge is allowed to project from the opening portion into outside the outer casing.

By adopting the above construction, it is possible to make small the lateral width of the information processing device by an amount corresponding to the outward projection from the outer casing of the carriage and/or ink ribbon cartridge at the terminal end of the stroke movement thereof.

Further, in the information processing device having the described construction, it is possible to provide the above-mentioned opening portion with a sensor which can operate in interlocking relation with an openable plate or door having a length greater than that corresponding to the outward projection of the carriage and/or ink ribbon cartridge from the outer casing through the opening portion. By providing such a sensor on the openable door, the opening or closing of the openable door is detected. This prevents the carriage and/or ink ribbon cartridge from colliding against the closed door, or an obstacle which may be located outside the outer casing. Thus, it is possible to provide an information processing device having a high level of safety as well as a reduced lateral width.

Other objects, features and advantages will become apparent from the following description when the same is read in conjunction with the accompanying drawings in which.

DESCRIPTION OF THE PREFERRED EMBODIMENTS

An embodiment of the present invention will now be described with reference to FIGS. 3 and 4.

Figure 1:
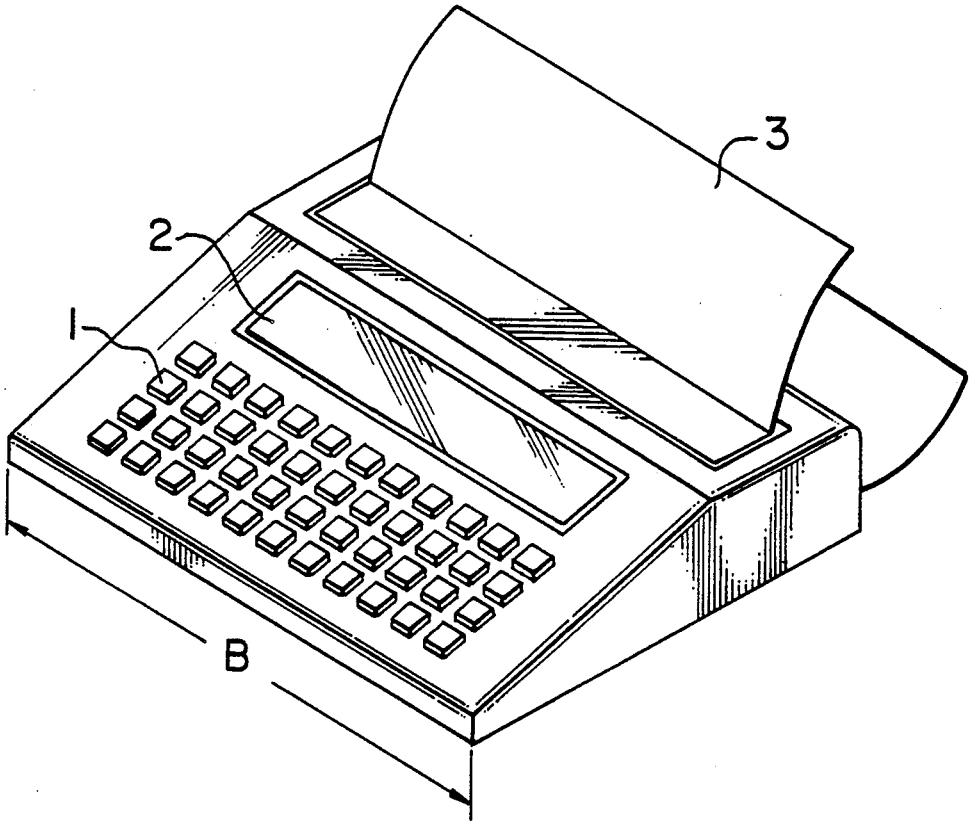
FIG. 1 is a perspective view of a conventional data-processing device.
Figure 2:
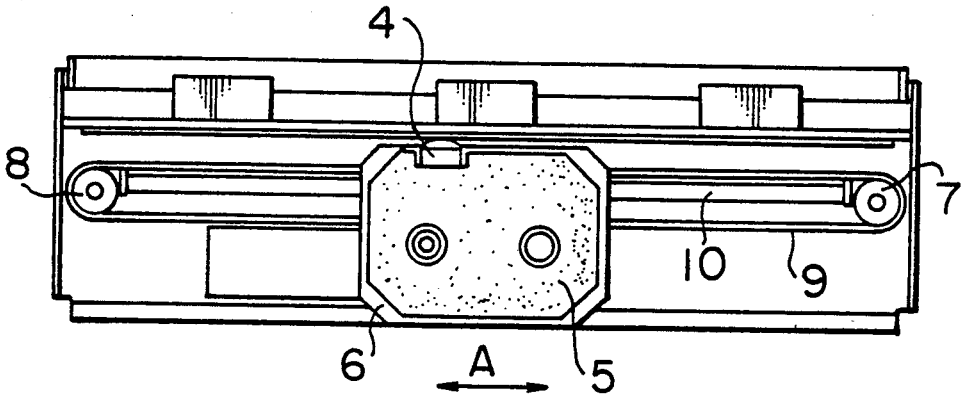
FIG. 2 is a plan view showing an ordinary structure of a serial printer.
Figure 3:
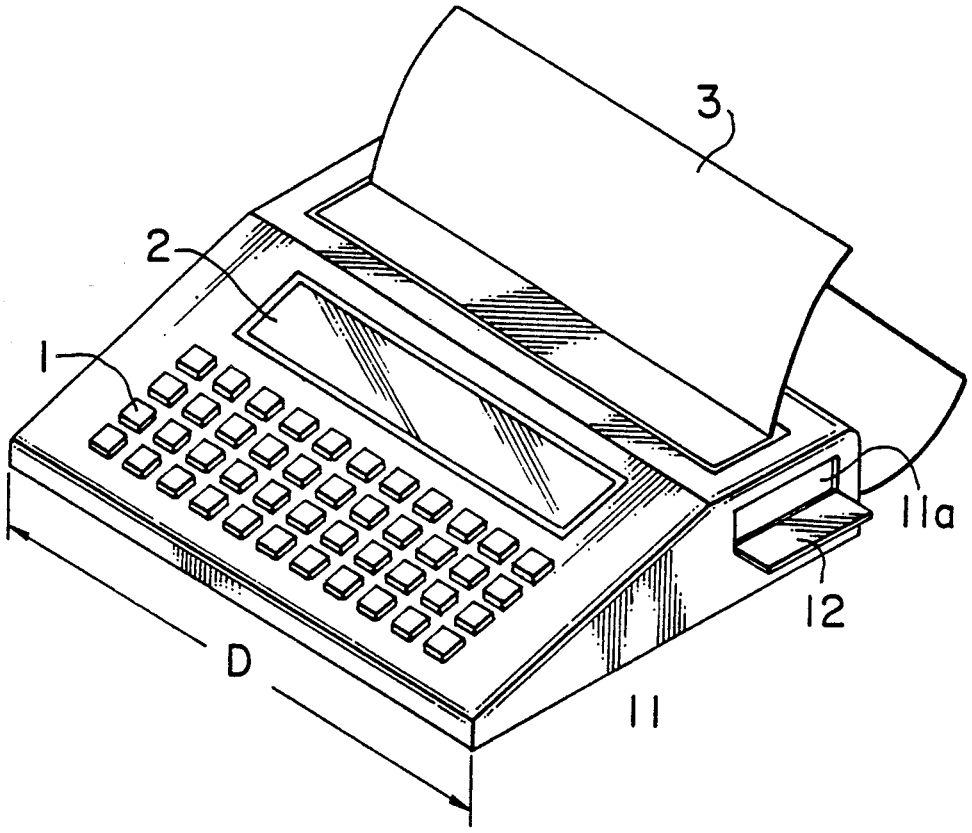
FIG. 3 is a perspective view of an information processing device in accordance with an embodiment of the present invention.

FIG. 3 is a perspective view showing the outer appearance of an information processing device according to the present invention. The information processing device of the present invention differs from the data-processing device of the prior art as show in FIG. 1 in that an outer casing 11 thereof is provided, at its right side, with an opening portion 11*a*, the opening portion 11*a* having an openable plate or door 12 supported at a lower end of the opening portion 11*a* by means of a hinge. The remaining part of the device construction in according with the present invention is the same as in the prior art. Therefore, like constituent parts or components are denoted by like reference numerals and any further description thereof is omitted.

Figure 4:
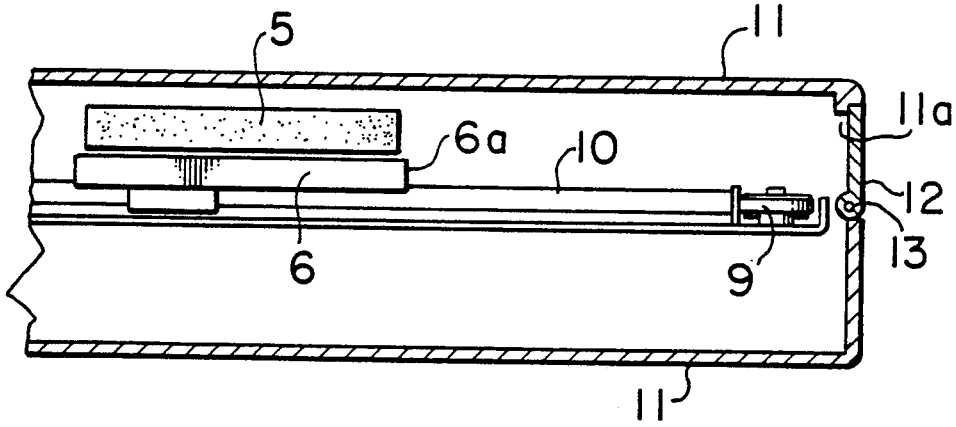
FIGS. 4 and 5 are front sectional views of essential portions thereof, respectively, FIG. 4 in particular being a front sectional view illustrating a state wherein a carriage of the serial printer has been moved to a right end of the information processing device shown in FIG. 3.
Figure 5:
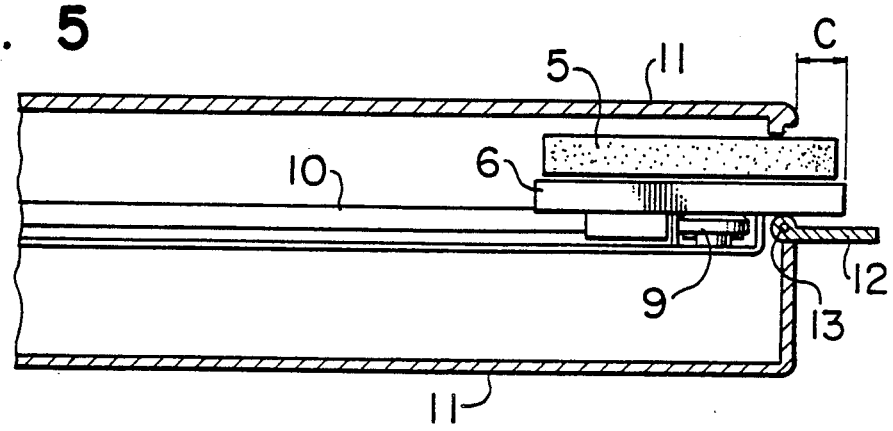

FIGS. 4 and 5 are both a front sectional view of an essential portion of the information processing device in accordance with the present invention.

In both Figures, a carriage 6 having loaded thereon an ink ribbon cartridge 5 is guided by a guide shaft 10 and is driven to make reciprocating movements by way of a belt 9. The openable door 12 at the right side of the outer casing 11 is mounted so that the openable door 12 can be rotated or swung about a hinge shaft 13. Further, the openable door 12 is urged counterclockwise by a spring means (not shown) so as to cover the opening portion 11*a*.

As the carriage 6 moves from the state shown in FIG. 4 toward the right side of the illustration, a right end 6*a* of the carriage 6 is brought into contact with the openable door 12. When the carriage 6 is further moved toward the right, the openable door 12 is pushed by the carriage 6 and is thereby swung clockwise, about the hinge, against the urging force of the spring means. Thus, the openable door 12 is automatically opened, so that the carriage 6 is allowed to project outside the outer casing 11. Thus, the lateral width of the information procession device as indicated by a dimensional line D in FIG. 3 can be reduced by the length indicated by a dimensional line C in FIG. 5.

Although, in this embodiment, the openable portion has been provided only at the right side surface of the outer casing 11 of the device, it is also possible to provide a structure wherein the openings are provided at both right side surface and left side surface, respectively.

In addition, in the above-described embodiment, the openable door 12 is urged counterclockwise by the spring means so as to cover the opening portion 11*a*. However, it is also possible to provide a stopper capable of holding the door in a state wherein the door 12 always kept urged clockwise is closed, and to release the holding of the door 12 by the stopper at the time when the carriage has been moved to, and has reached, the right end of the outer casing 11, thereby to cause the door 12 to be automatically opened.

Next, description will be made below of a safety device or means in the case where the information processing device has a structure wherein the openable door is held in place by means of the stopper.

Figure 6:
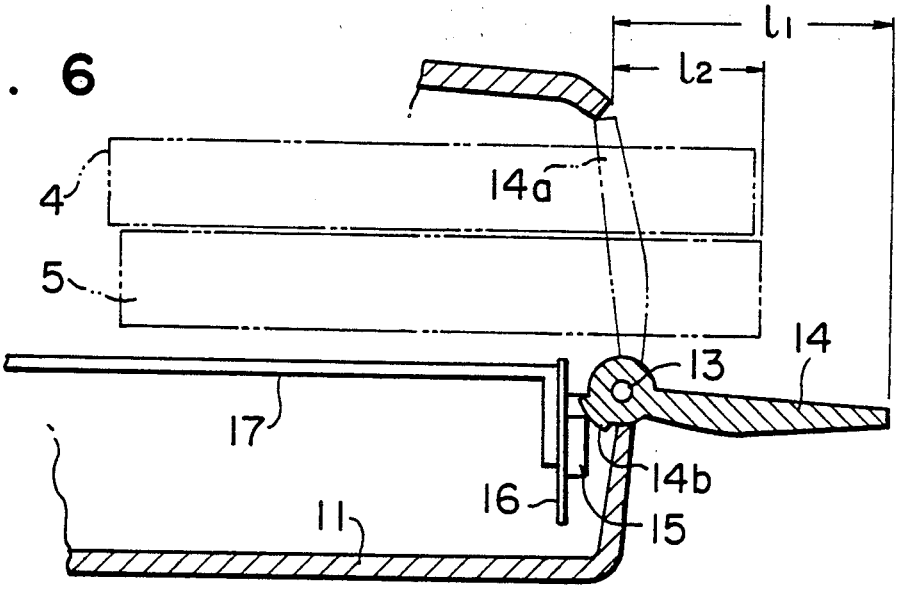
FIG. 6 is a sectional view of an essential portion of the information processing device in accordance with another embodiment of the present invention.
Figure 7:
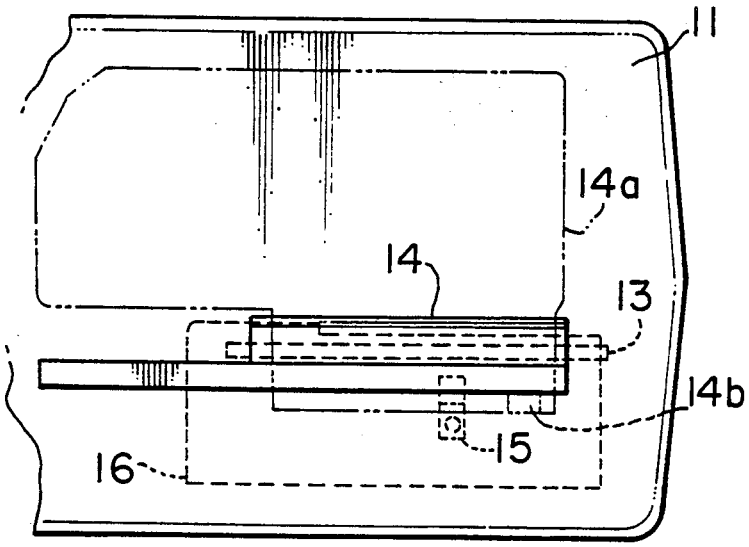
FIG. 7 is a right side view of an outer casing, including an opening formed at the right side thereof, of the information processing device.

FIGS. 6 and 7 are a detailed sectional view of the said opening portion and a right side view thereof, respectively. A reference numeral 14 denotes an openable plate or door and reference numeral 14*a* shows a state wherein the openable door 14 is closed and is being held by a stopper (not shown). Numeral 15 denotes a leaf switch for detecting the opening and closing of the openable door 14, the leaf switch being in contact with the openable door 14. The leaf switch has a contact which is acted by a protrusion 14*b* of the openable door. The leaf switch 15 is fixedly held by an angle 16, the angle 16 being also fixedly held on a chassis 17 of the printer. As shown in FIG. 6, the distance $l_1$ as measured from the right side end face of the outer casing 9 when the openable door 14 has been opened is made larger than the distance $l_2$ by which the carriage 5 is allowed to project ($l_1 > l_2$).

In consequence, by detecting the opened/closed condition of the openable door 14 by the leaf switch 15 so as to allow the carriage 5 to move only during a time period in which the openable door 14 is opened due to issue of a printing command signal, it is possible to prevent the carriage from colliding against the door. Further, by securing the space outside the operable door 14 through arrangement of $l_1 > l_2$ in FIG. 6, it is also possible to prevent the carriage 5 from colliding against any obstacle.

Further, where a printing command signal (a command signal for causing the carriage 5 to move) has been issued under a condition in which the openable door 14 is not opened, it is possible to arrange the device construction so as to prohibit the movement of the carriage, and in addition, it is possible to cause a display means to display a message to the effect that the openable door 14 is not opened.

In the above-described embodiment the operable door is prepared in the form of a rotary or swingable type. However the invention is not limited thereto. Namely, various types or systems such as a slidable door system, etc. can be adopted in this regard. Further, in the present embodiments, reference has been made to the information processing device containing all of a key-board, display means, and printer. However, the same effects or advantages can be obtained even if the device is used in such a manner that a printer and accessories thereto alone are contained in one casing while another casing containing a keyboard, display means, etc. is connected thereto.

What is claimed is:

1. An information processing device comprising a serial printer adapted to effect printing through reciprocating movements of a carriage loaded thereon with a printing head and an ink ribbon cartridge, characterized in that said device further comprises an outer casing having an opening portion at least one side surface thereof, whereby, when said carriage has reached a terminal end of its stroke for reciprocating movements, a part of either one, or both, of said carriage and said ink ribbon cartridge is allowed to project outside said outer casing through said opening portion.

2. An information processing device according to claim 1, characterized in that said device further comprises an openable door provided at said opening portion and a sensor for detecting whether or not said openable door is opened.

3. An information processing device according to claim 2, characterized in that the reciprocating movement of said carriage is controlled in accordance with an output detection signal from said sensor.

4. An information processing device according to claim 2, characterized in that said device further comprises display section which displays detection output delivered from said sensor.

5. An information processing device according to claim 1, characterized in that an openable door provided at said opening portion can automatically be opened by movement of said carriage.

6. An information processing device according to claim 5, characterized in that said openable door provided at said opening portion is urged in its closing direction by action of a spring force.

7. An information processing device according to claim 1, characterized in that said device further comprises a stopper capable of holding an openable door kept urged so as to close said openable door, said holding of said stopper being released by movement of said carriage, whereby said door can be automatically opened.

8. An information processing device according to claim 2, characterized in that said openable door has a length greater than that corresponding to a projection of said carriage or ink ribbon cartridge from said outer casing.

* * * * *